US005476389A

United States Patent [19]

Ono

[11] Patent Number: 5,476,389

[45] Date of Patent: Dec. 19, 1995

[54] ELECTRICAL CONNECTOR

[75] Inventor: Hisahiro Ono, Tsu, Japan

[73] Assignee: Matsushita Electric Works, Ltd., Osaka, Japan

[21] Appl. No.: 222,243

[22] Filed: Apr. 4, 1994

[30] Foreign Application Priority Data

Apr. 23, 1993 [JP] Japan ..... 5-098010

[51] Int. Cl.[6] ..... H01R 4/02

[52] U.S. Cl. ..... 439/83; 439/637

[58] Field of Search ..... 439/326, 636, 439/637, 83, 876

[56] References Cited

U.S. PATENT DOCUMENTS

| | | | |
|---|---|---|---|
| 4,907,979 | 3/1990 | Feldman | 439/83 OR |
| 4,955,820 | 9/1990 | Yamada et al. | 439/876 X |
| 4,990,107 | 2/1991 | Fortuna | 439/637 OR |
| 5,259,793 | 11/1993 | Yamada et al. | 439/637 OR |

*Primary Examiner*—Neil Abrams
*Assistant Examiner*—Daniel Wittels
*Attorney, Agent, or Firm*—Stevens, Davis, Miller & Mosher

[57] ABSTRACT

An electrical connector assembly has a socket body which is mounted on a printed board and is adapted for receiving a complementary plug with contacts. The socket body has a bottom and a pair of opposed side walls defining therebetween a cavity for receiving the plug. The socket body carries a plurality of connector contacts, each of which is bent to define an inner leg and an outer leg both extending from a bent. The inner leg extends along an inner surface of the side wall within the cavity for engagement with the contacts of the plug, while the outer leg extends downwardly from the bent along an outer surface of the side wall to define a terminal lead at its lower end. The terminal lead projects generally horizontally outwardly from the bottom of the socket body so as to be registered on a corresponding terminal site of a conductor pattern on the printed board and is welded thereto. With this structure, the entire terminal leads can be viewed for facilitating a visual inspection of possible soldering failure at the terminal leads.

7 Claims, 6 Drawing Sheets

ELECTRICAL CONNECTOR

BACKGROUND OF THE INVENTION

1. Field of the Invention

The present invention is related to an electrical connector, and more particularly, to such a modular electrical connector which is surface-mounted on a printed board for receiving an associated modular plug.

2. Background of the Invention

Surface-mounted electrical connecters have been widely utilized in communication and other electronic equipment. FIG. 1 shows a typical prior art connector which comprises a socket body 20A with a cavity 26A for receiving a complementary plug (not shown) with contacts. The socket body 20A carries a plurality of generally L-shaped connector contacts 30A each composed of an inner leg 31A and a terminal lead 34A. The inner leg 31A is secured at its lower end to the socket body 20A and extends vertically along the inner periphery of the cavity 26A for detachable engagement with the contacts of the plug. The terminal lead 34A extends horizontally outwardly from the lower end of the inner leg 31A and is adapted to be soldered at S on a corresponding site on a conductor pattern of the printed board for surface-mounting of the socket body 20A thereon. As apparent from the figure, since the terminal lead 34A is routed below the bottom of the socket body from the lower end of the inner leg 31A, a considerable portion of the terminal lead 34A is hidden below the socket body 20A, which renders it difficult to perform visual inspection of the soldering at the terminal leads 34A. This is particularly disadvantageous if, as schematically shown in FIG. 2, splashed droplets D of solder get in between the adjacent terminal leads 34A to thereby lower dielectric strength or even make electrical connection therebetween. Further, this connector structure suffers from a problem in that a flux utilized in the soldering is likely to advance upwardly through between the inner leg 31A and the socket body 20A by a capillary action to reach the inner leg 31A where it is brought into electrical connection with the contacts of the plug, thereby causing corrosion of the inner leg or hampering electrical connection between the inner leg and the contact of the plug by the presence of the flux therebetween.

SUMMARY OF THE INVENTION

The above problems and insufficiencies have been eliminated in an electrical connector assembly of the present invention. The electrical connector assembly comprises a socket body mounted on a printed board for detachable connection to a complementary plug with contacts. The socket body has a bottom and a pair of opposed side walls defining therebetween a cavity for receiving the plug. The socket body carries a plurality of connector contacts each of which is bent to define an inner leg and an outer leg both extending from a bent. The inner leg extends along an inner surface of the side wall within the cavity for electrical connection with the contacts of the plug, while the outer leg extends downwardly from the bent along an outer surface of the side wall to define a terminal lead at its lower end. The terminal lead projects horizontally outwardly from the bottom of the socket body so as to be registered on a corresponding terminal site of a conductor pattern on the printed board and welded thereto. With this structure in which the entire terminal leads can be disposed on the exterior of the socket body, visual inspection of the soldering at the terminals leads can be made easily and therefore reliably for facilitating to find any soldering failure thereat and unacceptable electrical connection between the adjacent terminal leads due to the inclusion of splashed droplets of the solder. Further, because of that a prolonged distance is given between the terminal lead and the inner leg where it is in electrical connection with the contact of the plug and also because of that the inner leg is connected to the outer leg by way of the bent at the upper end of the connector contact, a flux of the solder can be well prevented from reaching the inner leg even if the flux advances upwardly through between the outer leg and the socket body by a capillary action. Whereby, the inner leg of the connector contact can be kept free from the flux and therefore free from corrosion or poor electric connection to the plug.

Accordingly, it is a primary object of the present invention to provide an electrical connector assembly which is capable of easy and reliable visual inspection of the soldering at the terminal leads as well as of keeping the inner leg of the connector contact harmless from undesired invasion of the flux utilized in the soldering.

Formed on the opposite ends of the socket body is a pair of stands which project downwardly past the bottom for resting upon the printed board at the respective lower ends of the stands, thereby defining an open space between the bottom of the socket body and the printed board. Due to the provision of the open space, the visual inspection can be further facilitated, which is therefore another object of the present invention.

A preferred embodiment of the present invention discloses an improved connector assembly which is capable of absorbing shocks occurring when inserting the plug to the connector in order to keep the soldered terminal leads free from the shocks, yet retaining the above mentioned advantages. In this embodiment, the socket body comprises a stationary base and a movable base movable relative to the stationary base. The movable base is formed with a bottom and a pair of the side walls defining therebetween a cavity for receiving the plug. Each of the connector contacts are connected at its one end to the movable base and at the other end to the stationary base for supporting the movable base to the stationary base. The connector contact is configured to have a bent from which an inner and outer legs extending downwardly and to additionally includes a clamping leg extending from the bent between the inner and outer legs in a spaced relation thereto. The clamping leg extends in engagement with the outer surface of the side wall so as to clamp the side wall between the clamping leg and the inner leg. The outer leg extends downwardly from the bent in a spaced relation outwardly of the clamping leg so as to be given a resiliency which allows the clamping and inner legs to move together with the movable base relative to the stationary base in a direction of varying a spacing between the outer leg and the clamping leg. The outer leg is formed at its lower end with a terminal lead which projects horizontally outwardly away from a lower end of the stationary base for welding to a corresponding terminal site of a conductor pattern on the printed board. Due to the resiliency given to the outer leg, the movable base can be allowed to move relative to the stationary base to thereby absorb the shocks developed at the time of inserting the plug into the cavity of the movable base, thereby reducing the shocks transmitted to the soldered connection between the terminal lead and the printed board.

It is therefore a further object of the present invention to provide an improved electrical connector assembly which is capable of absorbing shocks applied when inserting the plug into the cavity of the socket body and therefore avoiding unacceptable separation of the terminal legs from the printed board.

Preferably, the lower end of the resilient outer leg is bifurcated to form the terminal lead and an anchor segment which is positioned immediately inwardly of the terminal lead and is anchored in the stationary base. With this result, the flexing force applied to absorb the shock can be received at the anchor segment and will not be transmitted to the terminal lead, thereby further assuring to avoid the separation of the terminal leg from the printed board for reliable electrical connection of the plug to a circuit of the printed board, which is therefore a further object of the present invention.

These and still other objects and advantageous features will become more apparent from the following detailed description of the preferred embodiments when taking in conjunction with the attached drawings.

DETAILED DESCRIPTION OF THE EMBODIMENTS

Figure 1:
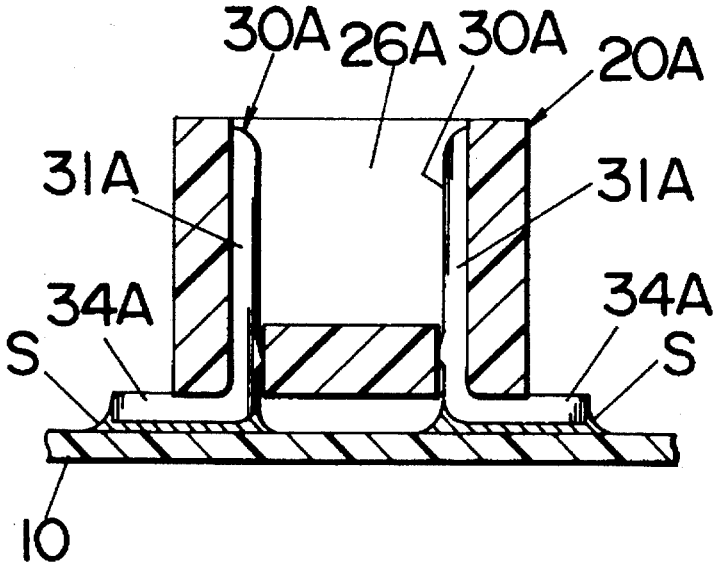
Fig.1 (PRIOR ART)
FIG. 1 is a sectional view of a prior art connector assembly.
Figure 2:
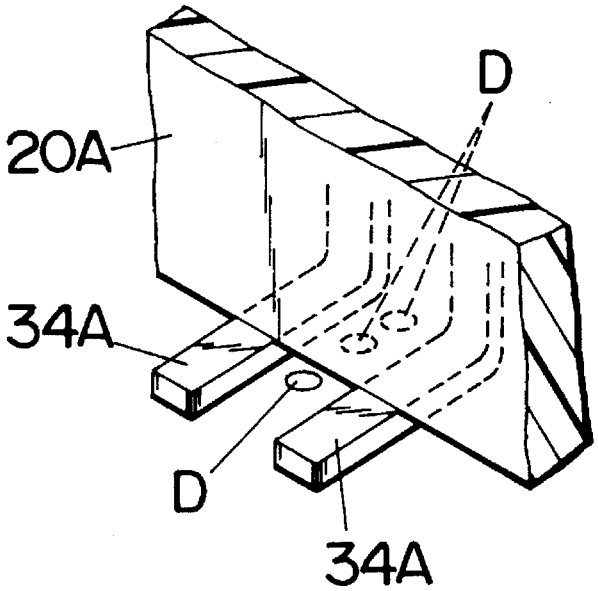
Fig.2 (PRIOR ART)
FIG. 2 illustrates a problem that may occur in the connector assembly of FIG. 1.
Figure 3:
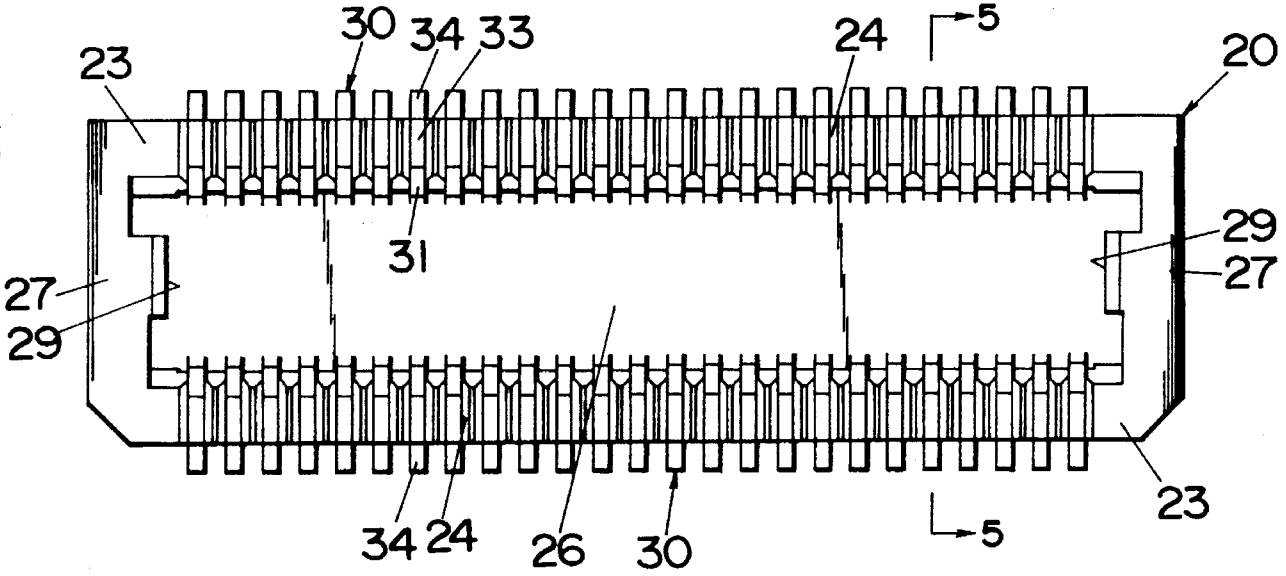
FIG. 3 is a top view of an electrical connector assembly in accordance with a first embodiment of the present invention.
Figure 4:
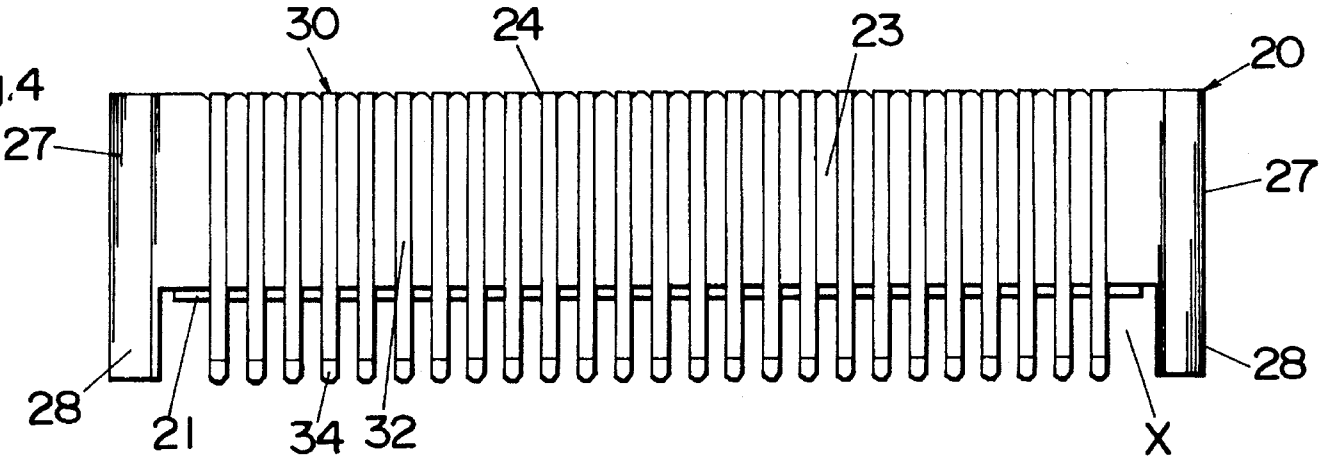
FIG. 4 is a front view of the connector assembly of FIG. 3.
Figure 5:
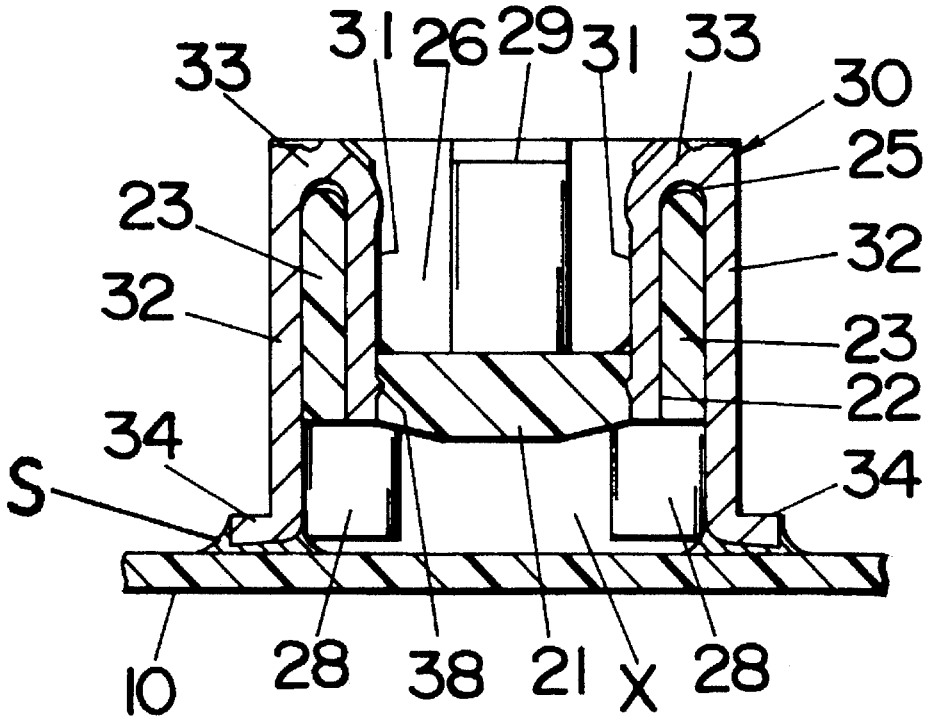
FIG. 5 is a sectional view taken along line 5—5 of FIG.3.
Figure 6:
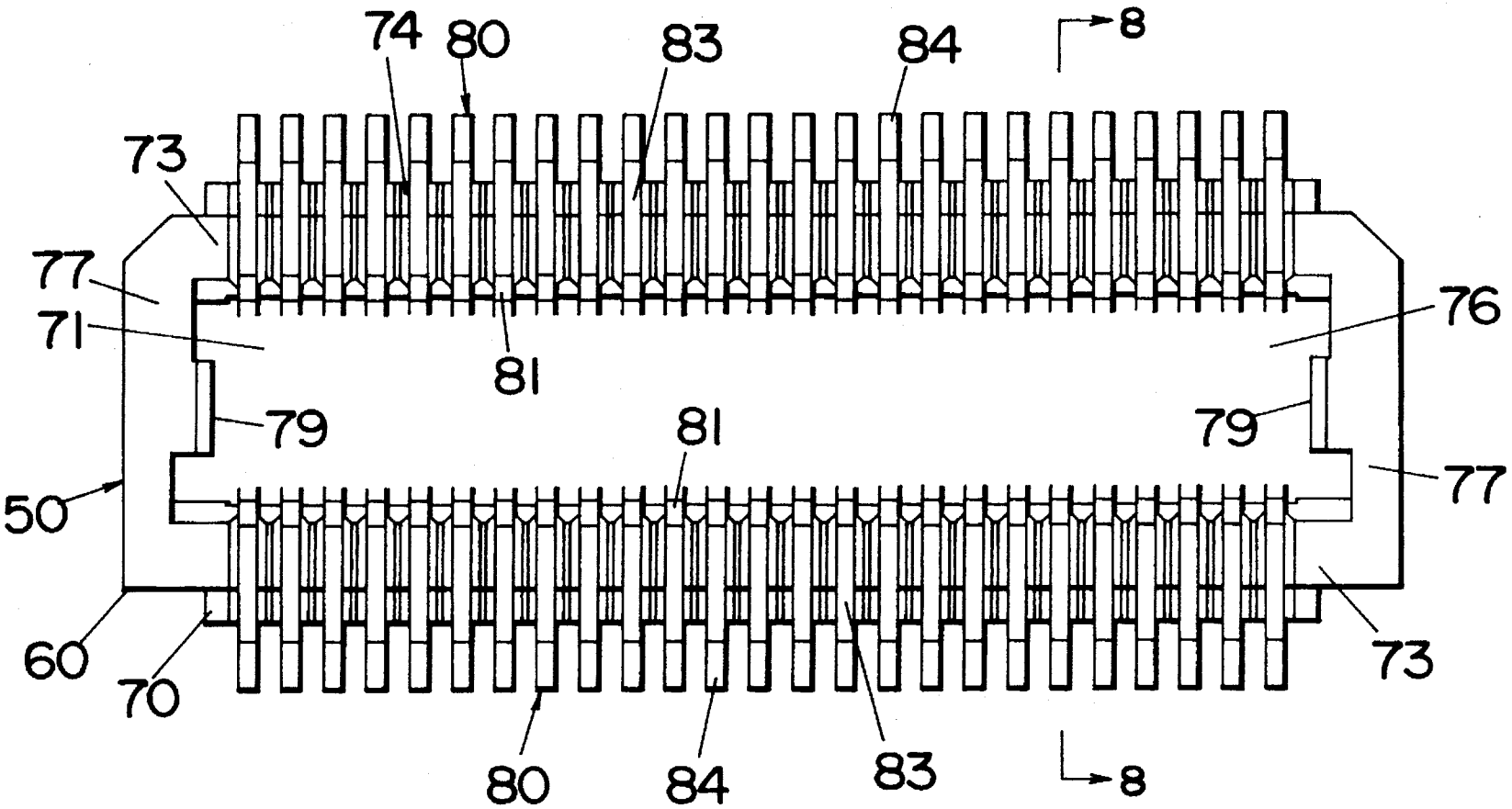
FIG. 6 is a top view of an electrical connector assembly in accordance with a second embodiment of the present invention.
Figure 7:
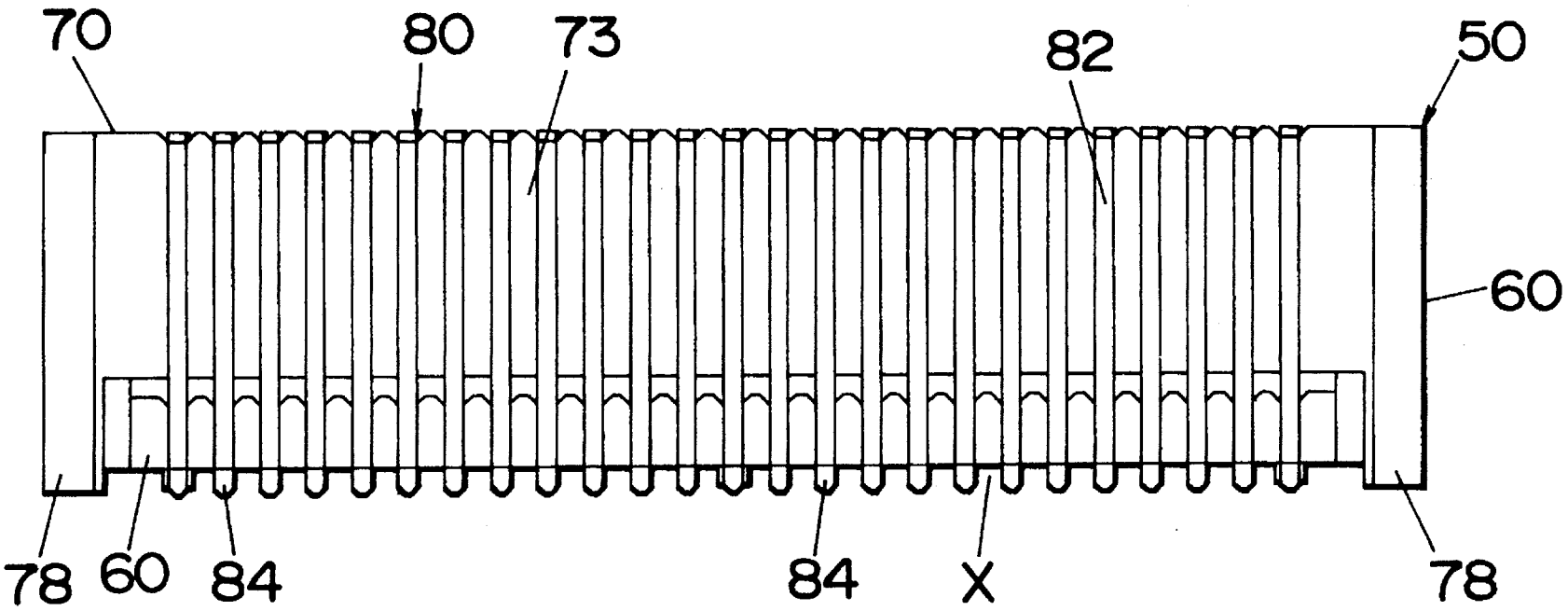
FIG. 7 is a front view of the connector assembly of FIG. 6.

Referring to FIG. 3 to 5, there is shown an electrical connector assembly in accordance with a first embodiment of the present invention. The connector assembly comprises a rectangular socket body 20 having a flat bottom 21 and a pair of elongated side walls 23 joined by opposed end walls 27 defining therein an elongated cavity 26 for receiving a complementary plug (not shown) with contacts in a dual-in-line configuration. Formed respectively at the opposed longitudinal ends of the socket body 20 are stands 28 which project downwardly from the bottom 21 and rest upon a printed circuit board 10 on which the socket body 20 is mounted. The socket body 20 gives therefore an open space X below the bottom 21 between the longitudinally spaced stands 28, which open space remains on the printed board 10 after the socket body 20 is mounted. Retainer hooks 29 are formed on the end walls 27 for engagement with the plug inserted in the cavity 26. Each of the side walls 23 is formed with an array of parallel vertical grooves 24 extending continuously in the inner and outer surfaces thereof and further into a slot 22 formed in each lateral end of the bottom 21, as shown in FIG. 5.

A plurality of connector contacts 30 are fitted respectively in the grooves 24 to be arranged along the longitudinal length of the socket body 20. Each of the connector contacts 30 is of a generally U-shaped configuration having a top bent 33 from which an inner leg 31 and an outer leg 32 extend downwardly, as shown in FIG. 5. The inner leg 31 depends along the inner surface of the side wall 23 to be disposed in the cavity 26 for electrical connection with the corresponding contact of the plug. The lower end of the inner leg 31 is inserted into the slot 22 with a spike 38 on the leg engaged into the socket body 20 to be secured thereto. The outer leg 32 extends from the bent 33 downwardly exterior of the socket body 20 and is formed at its lower end with a terminal lead 34 which projects horizontally outwardly from the lower end of the socket body 20 for welding by a solder S with a corresponding terminal site of a conductor pattern on the printed board 10. As apparent from the figures, the soldered terminal leads 34 can be readily inspected visually because of the terminal leads 34 projects outwardly from the outer leg 32 on the exterior of the socket body 20 and because of the presence of the open space X below the bottom 21 of the socket body between the stands 28. It is also noted that the inner leg 31 is spaced from the terminal lead 34 by the entire length of the outer leg 32 extending a full height of the socket body 20 and is further turned through the bent 33. Therefore, the inner leg 31 can be kept intact from a flux of the solder which might advance from the terminal lead 34 to a portion of the outer leg 32 through between the outer leg 32 and the socket body 20 by a capillary action, which protect the inner leg 31 from damaged by the flux. As shown in FIG. 5, the connector contact 30 is received in the groove 24 with a small clearance 25 left between the bent 33 and the bottom of the groove 24 at the upper end of the side wall 23. This clearance 25 interrupts a capillary path extending from between the outer leg 32 and the side wall 23 towards the inner leg 31. Whereby, even if a flux of the solder should creep towards the inner leg 31 over the outer leg 32 by the capillary action, the flux can be prevented from further advancing the inner leg 31 so that the inner leg 31 can be kept free from being damaged by the flux. The upper ends of the inner leg 31 and the side wall 23 are beveled for facilitating the insertion of the plug into the cavity 26. It is noted that the connector contact 30 can act as an effective heat sink for dissipating the heat developed when soldering the terminal lead 34 over the elongated length of the connector contact 30, thereby preventing a crack in the solder which might otherwise occur due to the difference in thermal expansion coefficient between the contact 30 and the printed board 10.

FIGS. 6 to 9 show another connector assembly in accordance with a second embodiment of the present invention, in which the connector assembly 50 comprises a stationary base 60 and a movable base 70. The stationary base 60 is of a generally elongated flat configuration on which the movable base 70 is supported to be slidable in a widthwise direction of the stationary base 60. The movable base 70 is of an elongated configuration having a bottom 71 and a pair of side walls 73 which are joined by opposed end walls 77 to define therebetween an elongated cavity 76 for receiving the plug. In order to allow the movable base 70 to move smoothly in the widthwise direction on the stationary base 60, the lower surface of the bottom 71 is rounded and the lateral end of the stationary base 60 is formed with rounded projections on which the side walls 73 are supported. The side walls 73 are formed respectively with arrays of vertical grooves 74 for receiving a plurality of connector contacts 80, respectively. The groove 74 extends through the entire height of the outer and inner surfaces of the side wall 73 and into a slot 72 formed in either lateral end of the bottom 71. The movable base 70 is formed at its longitudinal ends with stands 78 which rest upon the printed board 10. The stands 78 depend past the lower surface of the stationary base 60 to leave an open space between the stands 78. Retainer hooks 79 are formed on the inner surface of the opposite end walls 79 for engagement with the plugs inserted into the cavity 76.

Figure 8:
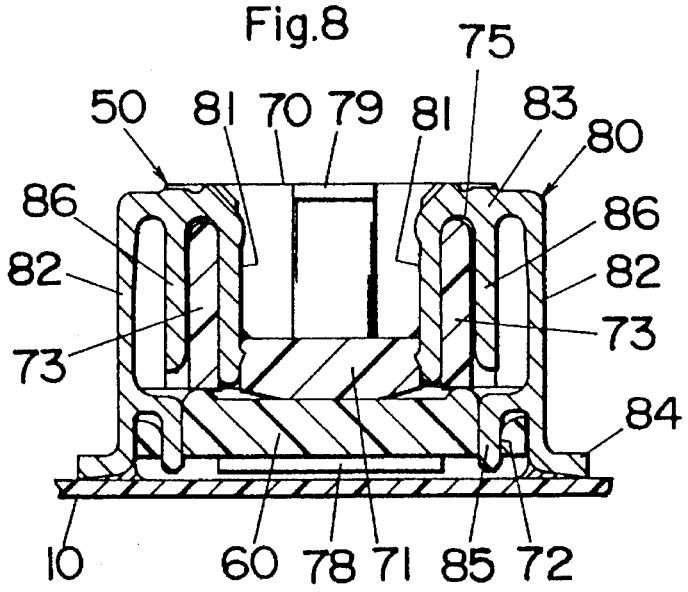
FIG. 8 is a sectional view taken along line 8—8 of FIG. 6.
Figure 9:
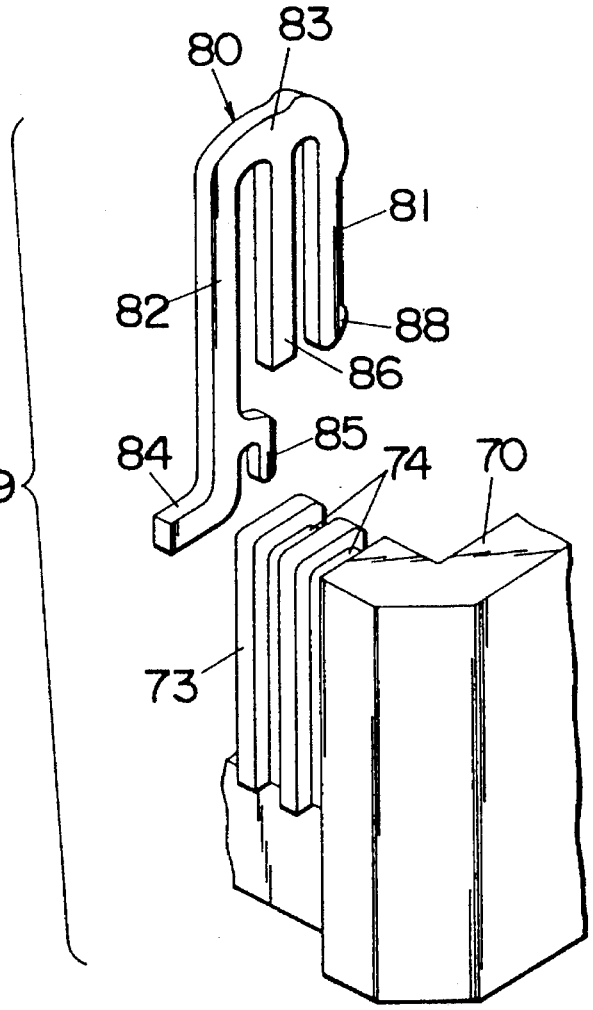
FIG. 9 is an exploded perspective view of a portion of the connector assembly of FIG. 6.

The connector contact 80 is configured to have an inner leg 81 and an outer leg 82 depending commonly from a bent 83 in substantially parallel relation to each other, as best shown in FIG. 9. Also, a clamping leg 86 depends from the bent 83 between the inner and outer legs in a spaced relation thereto. The clamping leg 86 is fitted in the groove 74 of the outer surface of the side wall 73 so as to clamp the side wall 73 with the inner leg 81 fitted in the groove 74 of the inner surface of the side wall 73 for clamping the side wall 73. The inner leg 81 is formed at its lower end with a spike 88 for secure engagement with the movable base 70. The outer leg 82 has its lower end bifurcated to define a terminal lead 84 and an anchor segment 85. The terminal lead 84 projects horizontally outwardly at a position downwardly of the bottom of the stationary base 60, while the anchor segment 85 is positioned immediately inwardly of the terminal lead 84 and is engaged into a hole 62 formed in the lateral end of the stationary base 60 so as to anchor the lower end of the outer leg 82 to the stationary base 60, as shown in FIG. 8.

As the outer leg 82 depends downwardly in a spaced relation from the clamping leg 86, it is given a resiliency which allows the clamping leg 86 and the inner leg 81 to move sideways or in the direction of varying a spacing between the outer leg 82 and the clamping leg 86 together with the movable base 70 relative to the stationary base 60. The resiliency comes from a material of the connector contact. The terminal leads 84 are placed on corresponding terminal sites of a conductor pattern on the printed board 10 and are soldered thereto for surface mounting of the socket body 50. Thus, the stationary base 60 is fixed relative to the printed board 10 by means of the soldered terminal leads 84, so that the movable base 70 is allowed to move sideways relative to the stationary base 70 or the printed board 10, thereby absorbing shocks applied to socket body 50 when inserting the plug into the cavity 76 for electrical connection to the printed board 10. In this connection, it is noted that the outer leg 82 is secured at its lower end to the stationary base 60 by means of the anchor segment 85 immediately adjacent to the terminal lead 84, so that the terminal leads 84 can be free from receiving a stress developed during the flexing of the outer leg 82 and be therefore kept secured to the printed board 10.

Also in this embodiment, the terminal leads 84 can be readily inspected visually after solder-mounting of the socket body 50, in addition to that the inner legs 81 can be kept free from the flux of the solder and that the connector contact 80 act as an effective heat sink for dissipating the heat developed at the soldering. Further, the connector contact 80 is fitted in the groove 74 to leave a clearance 75 between the bent 83 and the bottom of the groove 74 at the upper end of the side wall 73. The upper end of the inner leg 81 as well as the upper inner end of the side wall 73 are bevelled for facilitating the insertion of the plug into the cavity.

What is claimed is:

1. An electrical connector assembly which comprises:

a socket body mounted on a printed board, said socket body having a bottom and a pair of opposed side walls defining therebetween a cavity for detachably receiving a complementary plug with a plurality of contacts;

said socket body comprising a stationary base and a movable base movable relative to said stationary base and formed with said bottom and a pair of said side walls defining therebetween said cavity, a plurality of connector contacts carried by said socket body, each of said connector contacts being bent to define an inner leg and an outer leg both extending from a bent, said inner leg extending along an inner surface of said side wall within said cavity for electrical connection with the contacts of said plug, said outer leg extending downwardly from said bent along an outer surface of said side wall to define a terminal lead at its lower end, said terminal lead projecting generally horizontally outwardly from the bottom of said socket body so as to be registered on a corresponding terminal site of a conductor pattern on said printed board and welded thereto;

said connector contacts including a clamping leg extending from said bent between said inner and outer legs in a spaced relation thereto, said clamping leg extending in engagement with the outer surface of said side wall so as to clamp said side wall between said clamping leg and said inner leg, said outer leg extending downwardly from said bent in a spaced relation outwardly of said clamping leg so as to be given a resiliency which allows said clamping and inner legs to move together with said movable base relative to said stationary base in a direction of varying a spacing between the outer leg and said clamping leg, said outer leg having said terminal lead extending outwardly from a lower end of said stationary base.

2. An electrical connector assembly as set forth in claim 1, wherein said socket body includes a pair of stands on opposite ends of said socket body, said stands extending downwardly past said bottom to rest upon said printed board at the respective lower ends of said stands so as to define an open space between said bottom of the socket body and said printed board.

3. An electrical connector assembly as set forth in claim 1, wherein the lower end of said outer leg is bifurcated to form said terminal lead and an anchor segment which is positioned immediately inwardly of said terminal lead and is anchored in said stationary base.

4. An electrical connector assembly as set forth in claim 3, wherein each of said side walls of said movable base is formed with a groove extending from the inner surface to the outer surface thereof for receiving said inner and clamping legs, said inner leg having its lower end fitted into a corresponding slot in the bottom of said movable base so as to be anchored thereto.

5. An electrical connector assembly as set forth in claim 4, said connector contact is positioned in said groove so as to leave a clearance between the bent of said connector contact and a bottom of said groove at an upper end of said side wall.

6. An electrical connector assembly which comprises:

a socket body mounted on a printed board, said socket body having a bottom and a pair of opposed side walls defining therebetween a cavity for detachably receiving a complementary plug with a plurality of contacts;

a plurality of connector contacts carried by said socket body, each of said connector contacts being bent to define an inner leg and an outer leg both extending from a bent, said inner leg extending along an inner surface of said side wall within said cavity for electrical connection with the contacts of said plug, said outer leg extending downwardly from said bent along an outer surface of said side wall to define a terminal lead at its lower end, said terminal lead projecting generally horizontally outwardly from the bottom of said socket body so as to be registered on a corresponding terminal site of a conductor pattern on said printed board and welded thereto;

each of said side walls of said socket body being formed with a groove extending from the inner surface to the outer surface thereof for receiving said connector contact, said inner leg having its lower end fitted into a corresponding slot in the bottom of said socket body so as to be anchored thereto.

7. An electrical connector assembly as set forth in claim 6, said connector contact is positioned in said groove so as to leave a clearance between the bent of said connector contact and a bottom of said groove at an upper end of said side wall.

* * * * *